US005496680A

United States Patent [19]

Ohkawa et al.

[11] Patent Number: 5,496,680

[45] Date of Patent: Mar. 5, 1996

[54] COLOR DIFFUSION TRANSFER ELEMENT WITH BENZENESULFONAMIDE

[75] Inventors: Atsuhiro Ohkawa; Hiroshi Iwanaga; Hideaki Naruse; Masaaki Tsukase, all of Kanagawa, Japan

[73] Assignee: Fuji Photo Film Co., Ltd., Kanagawa, Japan

[21] Appl. No.: 340,367

[22] Filed: Nov. 14, 1994

[30] Foreign Application Priority Data

Nov. 15, 1993 [JP] Japan ..... 5-285030

[51] Int. Cl.[6] ..... G03C 8/10; G03C 8/14

[52] U.S. Cl. ..... 430/216; 430/218; 430/223; 430/487

[58] Field of Search ..... 430/203, 218, 430/223, 222, 216, 487

[56] References Cited

U.S. PATENT DOCUMENTS

| | | | |
|---|---|---|---|
| 3,928,312 | 12/1975 | Fleckenstein | 260/156 |
| 4,358,532 | 11/1982 | Koyama et al. | 430/223 |
| 4,590,154 | 5/1986 | Hirai et al. | 430/203 |
| 4,732,846 | 3/1988 | Aonoe et al. | 430/203 |
| 5,418,111 | 5/1995 | Naruse et al. | 430/218 |

FOREIGN PATENT DOCUMENTS

| | | | |
|---|---|---|---|
| 413701 | 3/1992 | Japan | G03C 8/40 |

*Primary Examiner*—Richard L. Schilling
*Attorney, Agent, or Firm*—Sughrue, Mion, Zinn, Macpeak & Seas

[57] ABSTRACT

There is disclosed a color diffusion transfer light-sensitive material in which a transferred density is increased and a processing temperature dependency of the transferred density is improved to a large extent. The above light-sensitive material comprises a color diffusion transfer light-sensitive element containing at least one of the compounds represented by the following Formula (I), and an alkali processing composition:

(I)

wherein $R^1$ represents an alkyl group; X represents an alkyl group, a cycloalkyl group, an aryl group, an alkoxy group, an aryloxy group, an acylamino group, a sulfonylamino group, a ureido group, an alkylthio group, an arylthio group, an alkoxycarbonyl group, a carbamoyl group, a sulfamoyl group, a sulfonyl group, an alkoxycarbonylamino group, an amino group, a sulfamoylamino group, a cyano group, a hydroxyl group, or a halogen atom; n represents an integer of 1 to 4; and when n is 2 or more, a plurality of X may be the same or different.

18 Claims, No Drawings

COLOR DIFFUSION TRANSFER ELEMENT WITH BENZENESULFONAMIDE

FIELD OF THE INVENTION

The present invention relates to a color diffusion transfer light-sensitive element, more specifically to a light-sensitive material in which a transferred density is increased and a processing temperature dependency of the transferred image density is improved to a large extent.

BACKGROUND OF THE INVENTION

There has so far been well known a color diffusion transfer photography using azo dye image-forming substance, in which a development under a basic condition results in providing an azo dye having different diffusibility from that of an image-forming compound itself. The compounds described in U.S. Pat. No. 3,928,312 are known in the art as a dye-releasing compound.

However, a dye-releasing efficiency of these dye-releasing compounds is not always high, and accordingly, there used to be involved the problem that a sufficient transferred density is not obtained.

Meanwhile, a conventional color diffusion transfer film unit is applied to indoor and outdoor photograph in many cases, and because of processing in a wide temperature range, the high processing temperature dependency of the transferred image density used is to be a problem.

These tendencies are particularly notable in the case where alkali processing is carried out at a low temperature. In such a sense, the techniques for improvements in transferred density and processing temperature dependency have been expected to appear.

With respect to means for improving in transferred density with an additive, a method in which a sulfonamide series compound in a form of a methanol solution is added to a dye-providing material-containing layer and processed at a high temperature in a dry film system is disclosed in JP-B-4-13701 (the term JP-B as used herein means an examined Japanese patent publication).

However, improvement effects for the transferred density and the processing temperature dependency were not observed with addition of the compounds disclosed in the patent described above.

Further, a method in which benzenesulfonamide is applied for the purposes of increasing the transferred density and improving the processing temperature dependency on a transferred temperature is disclosed in Japanese patent application No. 5-99458 (which corresponds to U.S. Ser. No. 08/233,701, now U.S. Pat. No. 5,418,111). While the improvement effect therewith is observed, further improvement has been desired.

SUMMARY OF THE INVENTION

An object of the present invention is to increase the transferred density and markedly improve the processing temperature dependency of the transferred density.

Another object is to provide a material having an excellent solubility.

Further object is to improve a color tone and a fastness of a dye. Still further object is to improve in a white background and post-transfer.

These objects according to the present invention have been achieved by following (1) to (6).

(1) A color diffusion transfer light-sensitive element containing at least one of the compounds represented by Formula (I):

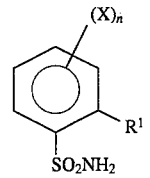

(I)

wherein $R^1$ represents an alkyl group; X represents an alkyl group, a cycloalkyl group, an aryl group, an alkoxy group, an aryloxy group, an acylamino group, a sulfonylamino group, a ureido group, an alkylthio group, an arylthio group, an alkoxycarbonyl group, a carbamoyl group, a sulfamoyl group, a sulfonyl group, an alkoxycarbonylamino group, an amino group, a sulfamoylamino group, a cyano group, a hydroxyl group, or a halogen atom; n represents an integer of 1 to 4; and when n is 2 or more, a plurality of X may be the same or different.

(2) The color diffusion transfer light-sensitive material described in (1), characterized by comprising the light-sensitive element described in above (1) and an alkali processing composition.

(3) The color diffusion transfer light-sensitive material described in (2), characterized in that the light-sensitive material described in above (2) is a color diffusion transfer film unit comprising (a) a light-sensitive sheet comprising a transparent support and provided thereon an image-receiving layer, a white color reflecting layer, a light-shielding layer, and at least one silver halide emulsion layer combined with at least one dye image-forming compound, (b) a transparent cover sheet having at least a neutralizing layer and a neutralization timing layer on a transparent support, and (c) the light-shielding alkali processing composition described in (2) spread between the above light-sensitive sheet and the above transparent cover sheet.

(4) The color diffusion transfer light-sensitive material described in (2), characterized in that the light-sensitive material described in above (2) is a color diffusion transfer film unit comprising (a) an image-receiving sheet comprising a neutralizing layer, a neutralization timing layer, an image-receiving layer and a peeling layer, each provided in order on a support, (b) a light-sensitive sheet having at least one silver halide emulsion layer combined with at least one dye image-forming compound on a support having a light-shielding layer, and (c) the alkali processing composition described in (2) spread between the above image-receiving sheet and the above light-sensitive sheet.

(5) A sulfonamide compound represented by Formula (II):

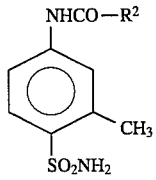

(II)

wherein $R^2$ represents a substituted or unsubstituted alkyl group.

(6) A sulfonamide compound represented by Formula (III):

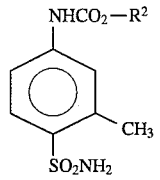

(III)

wherein $R^2$ is synonymous with that in Formula (II).

DETAILED DESCRIPTION OF THE INVENTION

The present invention will be explained below in detail. In the compound represented by Formula (I), R" represents an alkyl group(methyl, isopropyl, t-butyl, hexyl, and others) having preferably 4 or less carbon atoms and is particularly preferably methyl group.

X represents an alkyl group (an alkyl group having 1 to 30 carbon atoms, for example, methyl, t-octyl, dodecyl, and 2-hexyldecyl), a cycloalkyl group (cyclopentyl, and cyclohexyl), an aryl group (phenyl, and 2-naphthyl), an alkoxy group (methoxy, isopropyloxy, t-butyloxy, 2-ethylhexyloxy, and dodecyloxy), an aryloxy group (phenoxy, and 2,4-di-t-amylphenoxy), an acylamino group (acetylamino, N-ethyldodecanoylamino, and 2-n-heptylundecanoylamino), a sulfonylamino group (ethylsulfonylamino, and hexadecylsulfonylamino), a ureido group (3-hexadecylureido, and 3,3-dioctylureido), an alkylthio group (ethylthio, and dodecylthio), an arylthio group (phenylthio, and 2-naphthylthio), an alkoxycarbonyl group (ethoxycarbony, hexadecyloxycarbonyl, and 2-hexyldecyloxycarbonyl), a carbamoyl group (methylcarbamoyl, and dioctylcarbamoyl), a sulfamoyl group (dimethylsulfamoyl, and morpholinosulfonyl), a sulfonyl group (propylsulfonyl, and dodecylsulfonyl), an alkoxycarbonylamino group (methoxycarbonylamino, isopropoxycarbonylamino, and 2-hexyldecyloxycarbonylamino), an amino group (anilino, teradecylamino, and dioctylamino), a sulfamoylamino group (3,3-dioctylaminosulfamoylamino), a cyano group, a hydroxyl group, or a halogen atom (fluorine, chlorine, and bromine). These groups represented by X may further be substituted with substituents. The substituents include an acyl group, and a heterocyclic group in addition to the groups given for X.

X is preferably an alkyl group, an alkoxy group, an aryloxy group, an acylamino group, a ureido group, or an alkoxycarbonylamino group, particularly preferably the acylamino group or the alkoxycarbonylamino group. Suffix n represents an integer of 1 to 4 and is preferably 1 or 2, particularly preferably 1.

X has a total carbon atoms of preferably 8 or more, particularly preferably 12 or more, which are present in the number of 1 to 4. Of the compounds represented by Formula (I), a particularly preferred structure is contained that represented by Formula (II) or (III).

Next, the compounds represented by Formulas (II) and (III) will be explained.

$R^2$ represents a substituted or unsubstituted alkyl group. The substituents therefor are those listed as the substituents for X in the compound represented by Formula (I). Preferred as $R^2$ has 8 or more carbon atoms, particularly preferably 12 or more. Those preferred as the substituent are an aryloxy group, an alkoxy group, an aryl group, an acylamino group, a sulfonylamino group, and a halogen atom, particularly preferably the aryloxy group.

The compounds represented by the formulae (I), (II) and (III) are preferably to be incorporated into a layer containing a dye-image forming compound. Each of these compounds may be used in an amount of from 40 to 300 mols, preferably 40 to 200 mols and most preferably 40 to 100 mols, per mol of a dye-forming compound.

The concrete examples of the compound represented by Formula (I) used in the present invention will be-shown below but the present invention will not be limited thereto.

(I-1)

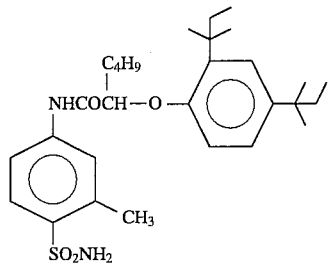

(I-2)

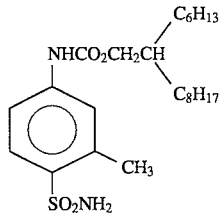

(I-3)

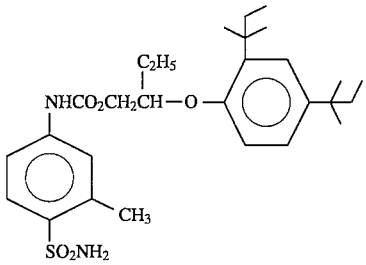

(I-4)

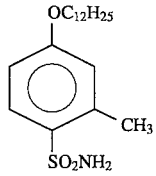

(I-5)

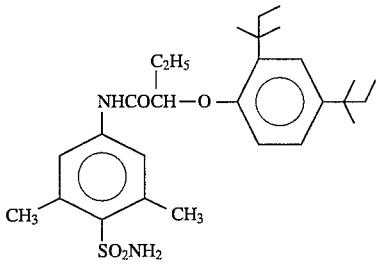

(I-6)

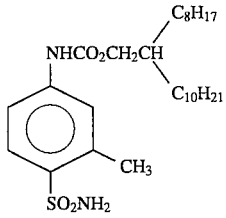

-continued (I-7)

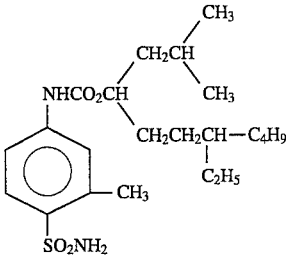

(I-8)

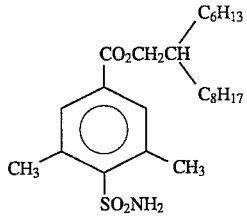

(I-9)

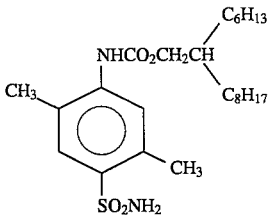

(I-10)

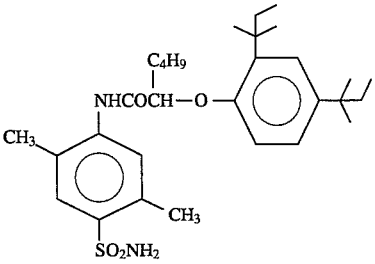

(I-11)

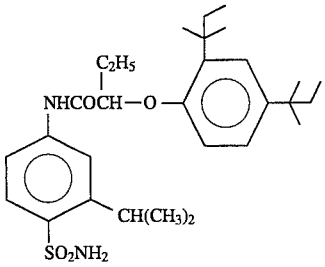

(I-12)

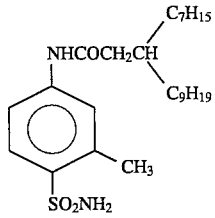

(I-13)

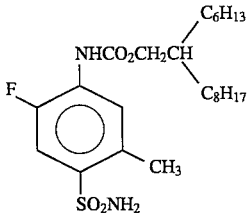

-continued (I-14)

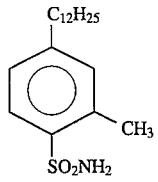

(I-15)

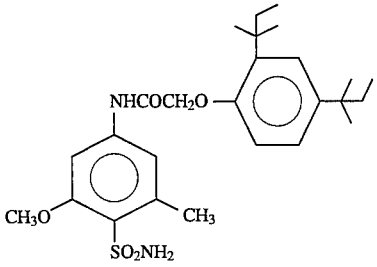

(I-16)

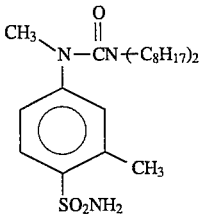

(I-17)

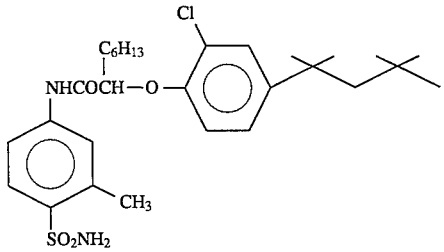

According to the present invention, a light-sensitive element is composed of a transparent cover sheet and a light-sensitive sheet which comprises a support, an image-receiving layer, a white reflecting layer, a light-shielding layer, a light-sensitive layer and a peeling layer.

The respective structural elements according to the present invention will be explained below.

I. Light-Sensitive Sheet

A) Support:

Any sheet can be used for a support for the light-sensitive sheet used in the present invention as long as it is a flat and transparent support usually used for a light-sensitive material. There can be used cellulose acetate, polystyrene, polyethylene terephthalate, and polycarbonate, and a subbing layer is preferably provided. The support usually contains a trace amount of a dye or a pigment such as titanium oxide in order to prevent light piping.

The support has a thickness of 50 to 350 μm, preferably 70 to 210 μm, and more preferably 80 to 150 μm.

A layer for adjusting a curl balance or an oxygen-shielding layer described in JP-A-56-78833 (the term JP-A as used herein means an unexamined published Japanese patent application) can be provided on the back side of the support according to necessity.

B) Image-receiving layer

A dye image-receiving layer used in the present invention contains a mordant agent in a hydrophilic colloid.

This layer may be a single layer or of a multilayer constitution in which the mordants each having a different mordant power are provided one above the other. This is described in JP-A-61-252551. A polymer mordant is preferred as the mordant.

The polymer mordant means a polymer having a secondary or tertiary amino group, a polymer having a nitrogen-containing heterocyclic ring portion, and a polymer containing a quaternary cation. It is the polymer having a molecular weight of 5,000 or more, particularly preferably 10,000 or more. A coating weight of the mordant is generally 0.5 to 10 g/m$^2$, preferably 1.0 to 5.0 g/m$^2$, and particularly preferably 2 to 4 g/m$^2$.

Used as hydrophilic colloid in an image-receiving layer are gelatin, polyvinyl alcohol, polyacrylamide, and polyvinyl pyrrolidone, and gelatin is preferred. There can be incorporated into the image- receiving layer, or the anti-fading agents described in JP-A-62-30620, JP-A-62-30621 and JP-A-62-215272.

C) White Reflecting Layer:

A white reflecting layer serving as a white background for a color image generally comprises a white pigment and a hydrophilic binder. Suitable white pigments include barium sulfate, zinc oxide, barium stearate, silver flakes, silicates, alumina, zirconium oxide, sodium zirconium sulfate, kaolin, mica, and titanium dioxide. Non-film-forming polymer particles, such as polystyrene particles, may also serve for whiteness. These white pigments may be used either individually or as a mixture thereof so as to control the reflectance as desired. A particularly useful white pigment is titanium dioxide.

While the degree of whiteness of the white reflecting layer varies with the kind and amount of the pigment or the pigment to binder mixing ratio, the reflecting layer preferably has a reflectance of 70% or higher. In general, the degree of whiteness increases with the pigment content. However, since the pigment particles in the reflecting layer also act as a barrier against diffusion of an image-forming dye passing therethrough, the amount of the pigment to be applied should be selected properly.

For example, titanium dioxide is preferably used in an amount of 5 to 40 g/m$^2$, still preferably 10 to 25 g/m$^2$, to form a reflecting layer which reflects 78 to 85% of light having a wavelength of 540 nm.

Titanium dioxide to be used may be chosen from various grades available on the market. In particular, titanium dioxide of rutile type is preferred. Many of commercially available titanium dioxide grades have their surface treated with alumina, silica, zinc oxide, etc. It is preferable for assuring a high reflectance to use those grades having been surface-treated with 5% or more of such a surface treating agent. Examples of commercially available titanium dioxide grades include Ti-Pure R931 produced by E. I. du Pont de Nemours & Co., Inc. and those described in *Research Disclosure* No. 15162.

The hydrophilic binder to be used includes alkali-penetrable high polymer matrices, such as gelatin, polyvinyl alcohol, and cellulose derivatives, e.g., hydroxyethyl cellulose, an carboxymethyl cellulose, with gelatin being particularly preferred. A weight ratio of the white pigment to gelatin ranges from 1/1 to 20/1, preferably 5/1 to 10/1.

The white reflecting layer preferably contains such a discoloration inhibitor as disclosed in JP-B-62-30620 and JP-A-62-30621.

D) Light-Shielding Layer:

A light-shielding layer comprising a light-shielding agent and a hydrophilic binder is provided between a white reflecting layer and a light-sensitive layer.

While any material having a light-shielding function may be employed as a light-shielding agent, carbon black is preferred. Degradable dyes described in U.S. Pat. No. 4,615,966 are also useful as a light-shielding agent.

The hydrophilic binder is not particularly limited as long as capable of dispersing carbon black. Gelatin is a preferred binder.

Carbon black to be used is not particularly limited by a method of production. For example, carbon black manufactured by a channel method, a thermal method, a furnace method, and the like as described in Donnel Voet, *Carbon Black*, Marcel Dekker, Inc. (1976) can be employed. While not limiting, the carbon black preferably has a particle size of 90 to 1800 Å.

The amount of the light-shielding agent (e.g., carbon black) to be added is decided according to the sensitivity of a light-sensitive material to be shielded from light. In general, it corresponds to an optical density of about 5 to 10.

E) Light-sensitive layer:

In the present invention, a light-sensitive layer comprising of a silver halide emulsion layer combined with a dye image-forming substance is provided over the above light-shielding layer. The constitutional elements will be described below.

(1) Dye image-forming substance:

The dye image-forming substance used in the present invention is a non-diffusible compound which releases a diffusible dye (which may be a dye precursor) in relation to a silver development or a compound in which a diffusibility of itself changes, and they are described in *The Theory of Photographic Process*, the fourth edition. Any of these compounds can be represented by Formula [IV]:

$$(\text{DYE-Y})_n\text{—Z} \qquad \text{(IV)}$$

wherein DYE represents a dye group, which represents a dye group temporarily shifted to a short wavelength, or a dye precursor group; Y represents a mere bond or a linkage group; Z represents a group having a property by which a difference is generated in diffusibility of the compound represented by $(\text{DYE-Y})_n$—Z corresponding or inversely corresponding to a light-sensitive silver salt having image-wisely latent image, or by which DYE is released and a difference is generated in diffusibility between released DYE and $(\text{DYE-Y})_n$—Z; n represents 1 or 2; and when n is 2, two DYE-Y's may be the same or different.

According to the function of said Z, the dye image-forming substances are classified broadly as a negative type compound which becomes diffusible in a silver-developed area and a positive type compound which becomes diffusible at an undeveloped area.

The concrete examples of negative type Z include those which are oxidized and split as the result of development to release a diffusible dye.

The concrete examples of Z are described in U.S. Pat. Nos. 3,928,312, 3,993,638, 4,076,529, 4,152,153, 4,055,428, 4,053,312, 4,198,235, 4,179,291, 4,149,892, 3,844,785, 3,443,943, 3,751,406, 3,443,939, 3,443,940, 3,628,952, 3,980,479, 4,183,753, 4,142,891, 4,278,750, 4,139,379, 4,218,368, 3,421,964, 4,199,355, 4,199,354, 4,135,929, 4,336,322, and 4,139,389, JP-A-53-50736, JP-A-51-104343, JP-A-54-130122, JP-A-53-110827, JP-A-56-12642, JP-A-56-16131, JP-A-57-4043, JP-A-57-650, JP-A-57-20735, JP-A-53-69033, JP-A-54-130927, JP-A-56-154342, and JP-A-57-119345.

Of Z in the negative type dye-releasing redox compound, there can be enumerated as a particularly preferred group, an N-substituted sulfamoyl group (N-substituent includes a group which is derived from an aromatic hydrocarbon ring and a heterocyclic ring). The representative examples of Z will be shown below but not limited thereto.

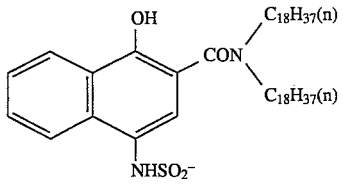

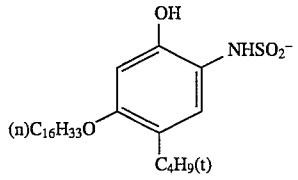

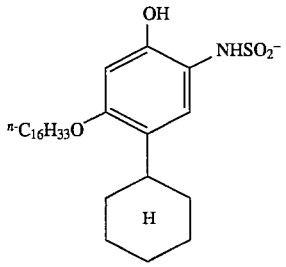

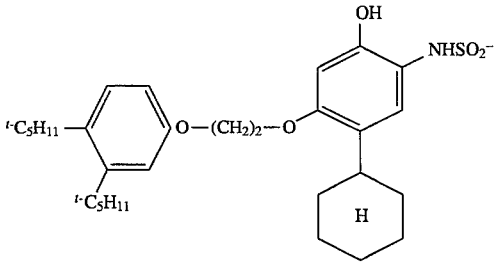

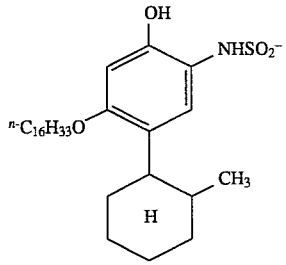

The positive type compounds are described in *Angev. Chem. Inst. Ed. Engl.* vol. 22, pp. 191 (1982).

The concrete example thereof includes a compound (a dye developer) which is initially diffusible under an alkaline condition but is oxidized by development to become non-diffusible. Those which are given in U.S. Pat. No. 2,983,606 are typical as Z which is effective for the compounds of this type.

Another type is a compound which is subjected to self-ring closure under an alkali condition to release a diffusible dye but is oxidized upon development to substantially stop releasing the dye. The concrete examples of Z having such function are described in U.S. Pat. No. 3,980,479, JP-A-53-69033, JP-A-54-130927, and U.S. Pat. Nos. 3,421,964 and 4,199,355.

Further, a different type includes a compound which does not release a dye by itself but releases the dye when it is reduced. The compound of this type is used in combination with an electron-donating material and can release image-wisely diffusible dye by a reaction with the rest of the electron-donating material which is imagewisely oxidized by silver development. The atomic groups having such a function are described in, for example, U.S. Pat. Nos. 4,183,753, 4,142,891, 4,278,750, 4,139,379, and 4,218,368, JP-A-53-110827, U.S. Pat. Nos. 4,278,750, 4,356,249, and 4,358,525, JP-A-53-110827, JP-A-54-130927, JP-A-56-164342, Kokai Giho (Technical Disclosure Bulletin) 87-6199, and European Patent-Publication 220746A2.

The concrete examples thereof will be shown below but not limited only thereto.

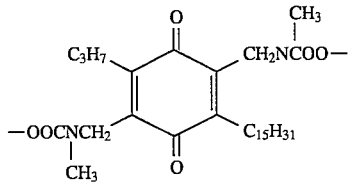

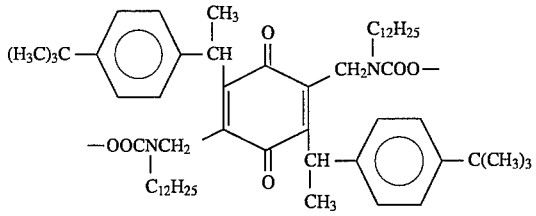

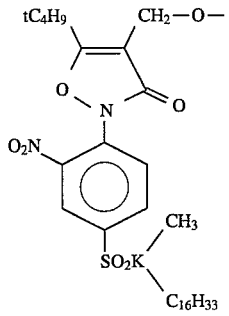

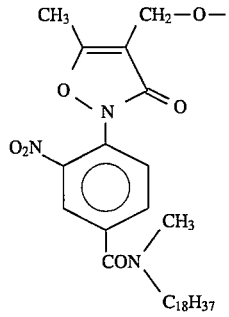

In the case where the compound of the above example is used, the use is made of preferably in combination with an anti-diffusible electron-donating material (known as an ED compound) or the precursor thereof. The examples of the ED compound are described in, for example, U.S. Pat. Nos. 4,263,393 and 4,278,750, and JP-A-56-138736.

The following compound can be used as an example of the dye image-forming material of another type:

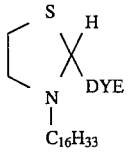

-continued

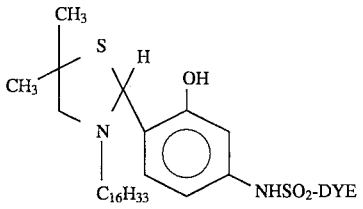

wherein DYE represents the same dye or precursor thereof as described previously.

The details thereof are described in U.S. Pat. Nos. 3,719,489 and 4,098,783. Meanwhile, the concrete examples of the dye represented by DYE in the foregoing formula are described in the following publications:

The examples of a yellow dye are described in U.S. Pat. Nos. 3,597,200, 3,309,199, 4,013,633, 4,245,028, 4,156,609, 4,139,383, 4,195,992, 4,148,641, 4,148,643, and 4,336,322; JP-A-51-114930 and JP-A-56-71072; and Research Disclosure 17630 (1978) and 16475 (1977).

The examples of a magenta dye are described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104, and 4,287,292; JP-A-52-106727, JP-A-53-23628, JP-A-55-36804, JP-A-56-73057, JP-A-56-71060, and JP-A-55-134.

The examples of a cyan dye are described in U.S. Pat. Nos. 3,482,972, 3,929,760, 4,013,635, 4,268,625, 4,171,220, 4,242,435, 4,142,891, 4,195,994, 4,147,544, and 4,148,642; British Patent 1,551,138; JP-A-54-99431, JP-A-52-8827, JP-A-53-47823, JP-A-53-143323, JP-A-54-99431, and JP-A-56-71061; European Patents (EP) 53,037 and 53,040; and Research Disclosure Nos. 17,630 (1978) and 16,475 (1977).

These compounds can be dispersed by the method described at pages 144 to 146 of JP-A-62-215272. Further, the compounds described at pages 137 to 144 of JP-A-62-215272 may be incorporated into these dispersions.

(2) Silver halide emulsion:

The silver halide emulsion used in the present invention may be either negative type emulsion in which a latent image is formed mainly on the surface of a silver halide grain or an internal latent image type direct positive emulsion in which a latent image is formed in the inside of a silver halide grain.

The internal latent image type direct positive emulsion includes, for example, so-called "conversion type" emulsion which is prepared by utilizing a difference in solubility of a silver halide and a "core/shell type" emulsion which is prepared by covering with an outer husk (shell) of a silver halide at least a light-sensitive site of an inner nucleus (core) grain of a silver halide which has been subjected to doping with a metal ion or chemical sensitization or to both of them. This is described in U.S. Pat. Nos. 2,592,250 and 3,206,313, British Patent 1,027,146, U.S. Pat. Nos. 3,761,276, 3,935,014, 3,447,927, 2,297,875, 2,563,785, 3,551,662, and 4,395,478, German Patent 2,728,108, and U.S. Pat. No. 4,431,730.

According to the present invention, various forms of the silver halide grain may be used. The form of example of these silver halide grains includes a regular crystal form, such as cubic, octahedron, tetradecahedron and rhombic dodecahedron, and crystals having high latitude face, i.e. (hkl) face or a mixture of these.

In the present invention, a remarkable advantage can be attained when a tabular silver halide grains are used.

When the internal latent image type direct positive emulsion is used, a surface fogging nucleus has to be given with light or a nucleating agent after imagewise exposing.

There are used as the nucleating agent therefor, hydrazines described in U.S. Pat. Nos. 2,563,785 and 2,588,982, hydrazines and hydrazones described in U.S. Pat. No. 3,227,552, the heterocyclic quaternary salt compounds described in British Patent 1,283,835, JP-A-52-69613 and U.S. Pat. Nos. 3,615,515, 3,719,494, 3,734,738, 4,094,683, and 4,115,122, the sensitizing dyes having a substituent with a nucleating function in the dye molecule, described in U.S. Pat. Nos. 3,718,470, the thioure-abonded type acylhydrazine series compounds described in U.S. Pat. Nos. 4,030,925, 4,031,127, 4,245,037, 4,255,511, 4,266,013, and 4,276,364, and British Patent 2,012,443, and the acylhydrazine series compounds to which a thioamide ring and a heterocyclic group such as triazole and tetrazole are bonded as an adsorbing group, described in U.S. Pat. Nos. 4,080,270 and 4,278,748, and British Patent 2,011,391B.

In the present invention, spectral sensitizing dyes are used in combination with these negative type emulsion and internal latent image type direct positive emulsion. The concrete examples thereof are described in JP-A-59-180550, JP-A-60-140335, Research Disclosure (RD) 17029, U.S. Pat. Nos. 1,846,300, 2,078,233, 2,089,129, 2,165,338, 2,231,658, 2,917,516, 3,352,857, 3,411,916, 2,295,276, 2,481,698, 2,688,545, 2,921,067, 3,282,933, 3,397,060, 3,660,103, 3,335,010, 3,352,680, 3,384,486, 3,623,881, 3,718,470, and 4,025,349.

(3) Constitution of the light-sensitive layer:

Reproduction of a natural color by a subtractive color process is achieved by using a light-sensitive layer comprising the combination of at least two components of an emulsion spectrally sensitized by the above spectral sensitizing dye and the above dye image-forming material which provides a dye having a selective spectral absorption in the same wavelength range. The emulsion and the dye image-forming material may be provided each in a different layer superposing one on another or both may be mixed to apply in a single layer.

Where the dye image-forming material has an absorption in the spectral sensitivity region of the emulsion combined therewith in the condition that it is coated, both are preferably provided each in a different layer. Also, the emulsion layer may consist of plural emulsion layers different in sensitivity, or an arbitrary layer may be provided between the emulsion layer and the dye image-forming material layer. There can be provided, for example, the layer containing a nucleus-forming development accelerator, described in JP-A-60-173541, and the partition wall layer described in JP-B-60-15267 to increase a dye image density, and a reflecting layer can be provided as well to raise the sensitivity of a light-sensitive element.

The reflecting layer contains a white pigment and a hydrophilic binder. The white pigment is preferably titanium oxide and the hydrophilic binder is preferably gelatin. A coating weight of titanium oxide is 0.1 to 8 g/m$^2$, preferably 0.2 to 4 g/m$^2$. The example of the reflecting layer is described in JP-A-60-91354.

In a preferred multi-layer constitution, there are provided in order from an exposure side, a combination unit of a blue-sensitive emulsion, a combination unit of a green-sensitive emulsion, and a combination unit of a red-sensitive emulsion.

An arbitrary layer can be provided between the respective emulsion layer units according to necessity. In particular, an intermediate layer is preferably provided in order to prevent an unfavorable affection which an effect by a development in some layer exerts on other emulsion layer units.

Where a developing agent is used in combination with a non-diffusible dye image-forming substance, an intermediate layer preferably contains a non-diffusible reducing agent in order to prevent the diffusion of the oxidation product of the developing agent. To be concrete, there can be enumerated non-diffusible hydroquinone, sulfonamidophenol, and sulfonamidonaphthol. To be further concrete, the non-diffusible reducing agents are described in JP-A-50-21249, JP-A-50-23813, JP-A-49-106329, JP-A-49-129535, U.S. Pat. Nos. 2,363,327, 2,360,290, 2,403,721, 2,544,640, 2,732,300, 2,782,659, 2,937,086, 3,637,393, and 3,700,453, British Patent 557,750, JP-A-57-24941, and JP-A-58-21249. The methods for dispersing them are described in JP-A-60-238831 and JP-B-60-18978.

Where a compound releasing a diffusible dye by a silver ion is used as described in JP-B-55-7576, a scavenger for the silver ion is preferably incorporated into an intermediate layer. In the present invention, an anti-irradiation layer, a UV absorbing layer and a protective layer may be provided on demand.

F) Peeling layer:

In the present invention, a peeling layer can be provided according to necessity in order to peel off at an arbitrary portion of a light-sensitive sheet in a unit after processing. Accordingly, the peeling layer has to be readily peeled off after processing. There can be used as the material for this, those described in, for example, JP-A-47-8237, JP-A-59-220727, JP-A-59-229555, JP-A-49-4653, U.S. Pat. Nos. 3,220,835 and 4,359,518, JP-A-49-4334, JP-A-56-65133, JP-A-45-24075, and U.S. Pat. Nos. 3,227,550, 2,759,825, 4,401,746, and 4,366,227.

One of the concrete examples thereof includes a water soluble (or alkali soluble) cellulose derivative. There are included, for example, hydroxyethyl cellulose, cellulose acetate phthalate, plasticized methyl cellulose, ethyl cellulose, cellulose nitrate, and carboxymethyl cellulose. Another example includes various natural high polymers, for example, alginic acid, pectin, and gum arabic. There are used as well various modified gelatin, for example, acetylated gelatin and phthalated gelatin. Further, another example includes water soluble synthetic polymer. There are included, for example, polyvinyl alcohol, polyacrylate, polymethyl methacrylate, polybutyl methacrylate, and a copolymer thereof.

The peeling layer may be composed of either single layer or plural layers as described in, for example, JP-A-59-220727 and JP-A-60-60642.

II. A Transparent Support

In the present invention, the color diffusion transfer light-sensitive material is desirably provided with a neutralizing function between a support and a light-sensitive layer or between the support and an image-receiving layer or on a cover sheet.

G) Support:

Any one can be used as a support for the cover sheet used in the present invention as long as it is a flat and transparent support generally used for a photographic light-sensitive material. There are used cellulose acetate, polystyrene, polyethylene terephthalate, and polycarbonate, and a subbing layer is preferably provided.

A trace amount of a dye is preferably incorporated into the support in order to prevent light piping.

H) Layer having neutralizing function:

The layer having neutralizing function used in the present invention is a layer containing an acid substance of an amount enough for neutralizing alkali carried over from a processing composition, and it may be of a multi-layer constitution comprising a neutralizing speed-controlling layer (a timing layer) and a layer for assuring close contact with a light-sensitive layer according to necessity. The preferred acid substance contains an acid group having pKa of 9 or less (or a precursor group giving such the acid group by a hydrolysis). There can be enumerated more preferably higher fatty acids such as oleic acid, described in U.S. Pat. No. 2,983,606, and a polymer of acrylic acid, methacrylic acid or maleic acid, and the partial ester or acid anhydride thereof, as disclosed in U.S. Pat. No. 3,362,819; a copolymer of acrylic acid and acrylic acid ester, as disclosed in French Patent 2,290,699; and latex type acid polymers, as disclosed in U.S. Pat. No. 4,139,383 and *Research Disclosure* No. 16102 (1977).

In addition to the above, there can be enumerated as well the acid substances disclosed in U.S. Pat. No. 4,088,493, JP-A-52-153739, JP-A-53-1023, JP-A-53-4540, JP-A-53-4541, and JP-A-53-4542.

The concrete examples of the acidic polymer are a copolymer of a vinyl monomer such as ethylene, vinyl acetate and vinyl methyl ether and maleic anhydride, and n-butyl ester thereof, a copolymer of butyl acrylate and acrylic acid, cellulose, and acetate hydrogen phthalate.

The acidic polymers can be used as mixed with a hydrophilic polymer. Such the polymers are polyacrylamide, polymethyl pyrrolidone, polyvinyl alcohol (including a partially saponified product), carboxymethyl cellulose, hydroxymethyl cellulose, hydroxyethyl cellulose, and polymethyl vinyl ether. Of them, polyvinyl alcohol is preferred.

A polymer other than a hydrophilic polymer, for example, cellulose acetate may be mixed in the above polymer acid. A coating weight of the-polymer acid is regulated by an amount of alkali spread in a light-sensitive element. An equivalent ratio per unit area of the polymer acid to alkali is preferably 0.9 to 2.0. Too small an amount of the polymer acid changes a hue of a transferred dye and causes stain on a white background.

Meanwhile, an excessive amount thereof causes inconveniences such as change of a hue and reduction of light resistance. More preferable equivalent ratio is 1.0 to 1.3. Either excessive or too small amount of a hydrophilic polymer to be mixed deteriorates a quality of a photograph. A weight ratio of the hydrophilic polymer to the polymer acid is 0.1 to 10, preferably 0.3 to 3.0.

In the present invention, additives can be incorporated into the layer having a neutralizing function for various purposes. For example, there can be added a hardener which is known to a person ordinary skilled in the art for the purpose of hardening the layer, and a polyhydroxyl compound such as polyethylene glycol, polyepropylene glycol and glycerine in order to improve brittleness of a layer. In addition to the above, there can be added as well according to necessity, an anti-oxidation agent, a fluorescent whitening agent, and a development inhibitor and a precursor thereof.

Useful for a timing layer which is used in combination with a neutralizing layer are, for example, a polymer which lowers alkali permeability, such as, for example, gelatin, polyvinyl alcohol, a partially acetalized product of polyvinyl alcohol, cellulose acetate, and partially hydrolyzed polyvinyl acetate; a latex polymer which is prepared by copolymerizing a small amount of a hydrophilic comonomer such as an acrylic acid monomer and which increases an activation energy for alkali permeation; and a polymer having a lactone ring.

Above all, particularly useful are a timing layer in which cellulose acetate is used, disclosed in JP-A-54-136328, and U.S. Pat. Nos. 4,267,262, 4,009,030, and 4,029,849; a latex polymer prepared by copolymerizing a small amount of a hydrophilic comonomer such as acrylic acid, disclosed in JP-A-54-128335, JP-A-56-69629, JP-A-57-6843, and U.S. Pat. Nos. 4,056,394, 4,061,496, 4,199,362, 4,250,243, 4,256,827, and 4,268,604; the polymer having a lactone ring, disclosed in U.S. Pat. No. 4,229,516; and in addition, the polymers disclosed in JP-A-56-25735, JP-A-56-97346, JP-A-57-6842, and European Patents (EP) 31,957A1, 37,724A1 and 48,412A1.

In addition to the above, those described in the following publications can be used as well: U.S. Pat. Nos. 3,421,893, 3,455,686, 3,575,701, 3,778,265, 3,785,815, 3,847,615, 4,088,493, 4,123,275, 4,148,653, 4,201,587, 4,288,523, and 4,297,431, German Patent Applications (OLS) 1,622,936 and 2,162,277, and *Research Disclosure* 15162, No. 151 (1976).

The timing layer in which these materials are contained may be used in a single layer or a combination of two or more layers.

It is possible to incorporate into the timing layer comprising these materials, for example, the development inhibitors and/or a precursors thereof, disclosed in U.S. Pat. No. 4,009,029, German Patent Applications (OLS) 2,913,164 and 3,014,672, and JP-A-54-155837 and JP-A-55-138745; a hydroquinone precursor disclosed in U.S. Pat. No. 4,201,578; and other photographically useful additives or the precursors thereof.

Further, it is effective for minimizing reduction of change in transferred image density attributable to aging after processing to provide an auxiliary neutralizing layer as a layer having neutralizing function described in JP-A-63-168468 and JP-A-63-168649.

I) Others

In addition to the layer having a neutralizing function, there may be provided as a layer having an auxiliary function, a back layer, a protective layer, and a filter dye layer.

The back layer is provided in order to adjust curling and provide lubrication. A filter dye may be added to this layer. The protective layer is used mainly for the purpose of preventing adhesion with a cover sheet back face and adhesion with a protective layer of a light-sensitive material when the light-sensitive material and the cover sheet are superposed. A dye can be incorporated into the cover sheet to control sensitivity of a light-sensitive layer. A filter dye may be added directly to a support of the cover sheet, a layer having a neutralizing function, and further the above back layer, protective layer and capturing mordant layer, or an independent layer containing thereof may be provided.

III. Alkali processing composition:

The processing composition used in the present invention is uniformly spread on a light-sensitive element after the light-sensitive element is exposed, and attached with a light-shielding layer provided on the back side of a support or the side opposite to a processing solution on a light-sensitive layer to completely shield the light-sensitive layer from light coming from the outside. In addition, the processing composition develops the light-sensitive layer with the components contained therein. For this purpose, there are contained in the composition, an alkali, a thickener, a light-shielding agent, a developing agent, a developing accelerator and a developing inhibitor each used for adjusting development, and an anti-oxidation agent used for preventing the developing agent from deterioration. The light-shielding agent should be contained in the composition without fail.

The alkali may be enough for adjusting pH from 12 to 14 and includes a hydroxide of an alkali metal (for example, sodium hydroxide, potassium hydroxide and lithium hydroxide), phosphate of an alkali metal (for example, potassium phosphate), guanidines, and a hydroxide of a quaternary amine (for example, tetramethylammonium hydroxide). Of them, potassium hydroxide and sodium hydroxide are preferred.

The thickener is required for uniformly spreading a processing solution and keeping an intimate contact between a light-sensitive layer and cover sheet. There is used, for example, polyvinyl alcohol, hydroxyethyl cellulose, and an alkali metal salt of carboxymethyl cellulose. Hydroxyethyl cellulose and sodium carboxymethyl cellulose are preferably used.

There can be used as the light-shielding agent, either a dye or a pigment, or the combination thereof as long as it is not diffused to a dye image-receiving layer to generate a stain.

Carbon black can be given as a typical example.

Any one can be used as a preferred developing agent as long as it cross-oxidizes a dye image-forming material and does not substantially generate a stain upon oxidation. The developing agent may be used either singly or in combination of two or more kinds or in the form of a precursor. These developing agents may be contained in a suitable layer of a light-sensitive element or in an alkali processing solution. The concrete compound includes aminophenols and pyrazolidinones. Of them, pyrazolidinones are particularly preferred because of less stain generation. There are included, for example, 1-phenyl-3-pyrazolidinone, 1-p-tolyl-4,4dihydroxymethyl-3-pyrazolidinone, 1-(3'-methyl-phenyl)-4-methyl-4-hydroxymethyl-3-pyrazolidinone, 1-phenyl-4-methyl-4-hydroxymethyl-3-pyrazolidinone, and 1-p-tolyl-4-methyl-4-hydroxymethyl-3-pyrazolidinone.

There can be incorporated into any of the light-sensitive sheet, the cover sheet and the alkali processing composition, the development accelerators described at pages 72 to 91, the hardeners described at pages 146 to 155, the surface active agents described at pages 201 to 210, the fluorine-containing compounds described at pages 210 to 222, the thickeners described at pages 225 to 227, the anti-static agents described at pages 227 to 230, the polymer latexes described at pages 230 to 239, and the matting agents described at page 240 each of JP-A-62-215272.

These alkali liquid compositions are desirably transferred on a light-sensitive material in a spreading thickness (as an amount of a processing solution per $m^2$ after transferring the processing solution) of 20 μm to 200 μm.

A processing temperature in processing the light-sensitive material containing the compound of Formula (I) is preferably 0° to 50° C., more preferably 0° to 40° C.

The synthetic method for preparing the compound of the present invention will be explained. The compound of the present invention represented by Formula (I) can be synthesized by using a conventional organic synthetic process in which benzenesulfonic acid is led to benzenesulfonamide after introducing a substituent thereinto or converting a functional group, or various substituents are introduced into benzenesulfonamide or the functional group thereof is converted.

The synthetic examples of the compounds according to the present invention will be shown below, which are not to be construed as limiting the scope thereof.

Example 1

Synthesis of the exemplified compound (I-1):

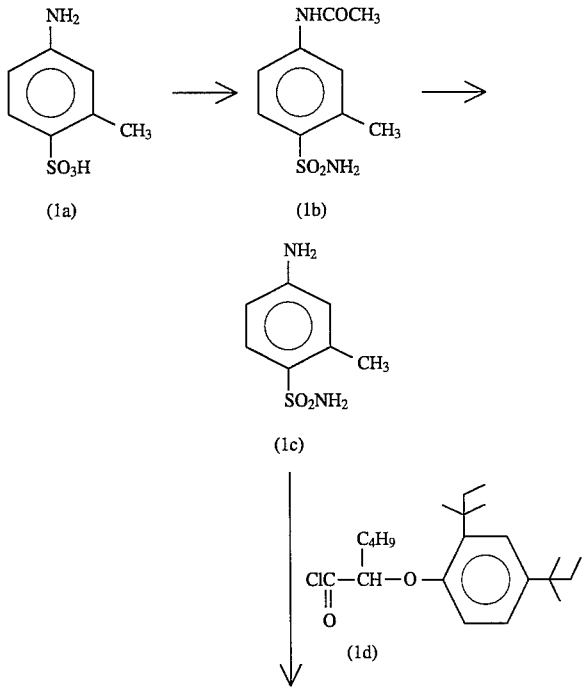

Examplified Compound (I-1)

The mixture comprising a compound 1a (0.20 mol), acetic anhydride (0.30 mol), sodium acetate (0.21 mol) and acetonitrile (400 ml) was refluxed for one hour and cooled to 30° C. N,N-dimethylacetamide (40 ml) and phosphorus oxychloride (0.60 mol) were added thereto and reacted for one hour at 50° C. After cooling to a room temperature, the reaction mixture was poured into the mixture of ice (400 g) and water (1 liter), and after stirring for one hour at 10° C. or lower, a deposited crystal was filtered off. The crystal, thus, obtained, was added to a mixture of 37% aqueous ammonia solution (130 ml) and acetonitrile (200 ml) and the reaction was carried out for 2 hours. After neutralizing the mixture with hydrochloric acid, ethyl acetate (400 ml) was added to separate phases, and an aqueous phase was removed. After washing twice, an organic phase with water (300 ml), concentration was carried out to obtain a compound 1b of 0.14 mol.

Next, after adding the compound 1b (0.10 mol) to an aqueous solution (40 ml) of sodium hydroxide (20 g) to carry out a reaction for 2 hours at 80° C., a reaction mixture was cooled to a room temperature and neutralized with hydrochloric acid. A deposited white crystal was filtered off to obtain a compound 1c of 0.095 mol.

The compound 1c (0.05 mol) and the compound 1d (0.05 mol) were reacted for 3 hours in N,N-dimethylacetamide. After adding ethyl acetate (200 ml) and 1N hydrochloric acid (300 ml) to separate liquids, an aqueous layer was removed. Further, after washing twice an organic layer with 1N hydrochloric acid (200 ml), concentration was carried out. Refining was carried out with a silica gel chromatography (eluent ethyl acetate-hexane= 1:4 to 1:1 by volume ratio) to obtain the exemplified compound (I-1) of 0.0465 mol. Melting point: 86.0° to 88.0° C.

Example 2

Synthesis of the exemplified compound (I-12):

The compound was synthesized in the same manner as that in Synthetic Example 1, to obtain a compound (I-12) having a melting point of 75.5° to 77.0° C.

Example 3

Synthesis of the exemplified compound (I-7):

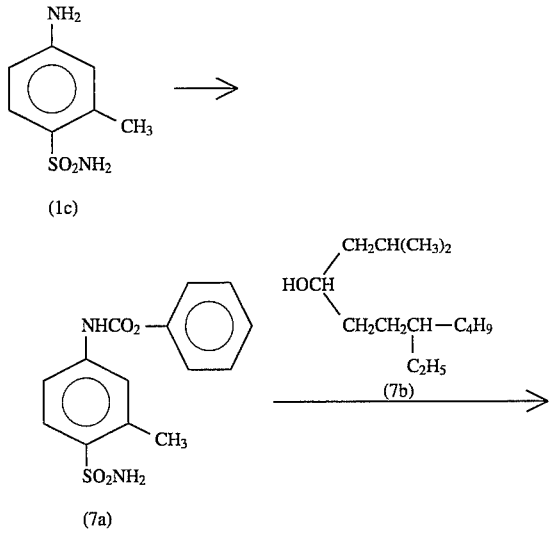

Exemplified Compound (I-7)

The compound 1c (0.10 mol), phenyl chlorocarbonate (0.11 mol) and sodium bicarbonate (0.22 mol) were reacted for 4 hours in the mixed solution of tetrahydrofuran (200 ml) and water (200 ml). After adding ethyl acetate (200 ml) to separate phases, an aqueous phase was removed. Further, after washing an organic phase with an aqueous 3% sodium bicarbonate solution (200 ml) and 1N hydrochloric acid (200 ml×2), respectively, concentration was carried out to almost quantitatively obtain a compound 7a.

Next, the compound 7a (0.05 mol) and a compound 7b (0.25 mol) were reacted for 3 hours at 230° C. After cooling down to a room temperature, methylene chloride (50 ml) was added. Refining was carried out with a silica gel chromatography (eluent: methylene chloride) to obtain the exemplified compound (I-7) of 0.036 mol (wax).

Example 4

Synthesis of the exemplified compound (I-2):

Synthesis was carried out in the same manner as that in Synthetic Example 3. Melting point: 95.0° to 96.7° C.

Example 5

Coating was carried out on a transparent polyethylene terephtalate film support of 150 μm in the layer structure shown in Table 1 to prepare the comparative light-sensitive material 101.

TABLE 1

Structure of the comparative light-sensitive element 101

| Layer No. | Layer name | Additive | Coated amount ($g/m^2$) |
|---|---|---|---|
| 21st layer | Protective layer | Gelatin | 1.00 |
| | | Matting agent (1) | 0.25 |
| 20th layer | UV absorbing layer | Gelatin | 0.50 |
| | | UV absorber (1) | $4.0 \times 10^{-4}$ |
| | | UV absorber (2) | $4.0 \times 10^{-4}$ |
| 19th layer | Yellow-sensitive layer (high sensitivity) | Internal latent image type direct positive emulsion (octahedron having grain size of 1.7 μm) | 0.48 (as Ag) |
| | | Sensitizing dye (3) | $1.4 \times 10^{-3}$ |
| | | Nucleating agent (1) | $6.8 \times 10^{-8}$ |
| | | Additive (2) | 0.03 |
| | | Gelatin | 0.70 |
| 18th layer | Yellow-sensitive layer (low sensitivity) | Internal latent image type direct positive emulsion (octahedron having grain size of 1.1 μm) | 0.20 (as Ag) |
| | | Sensitizing dye (3) | $9.0 \times 10^{-4}$ |
| | | Nucleating agent (1) | $8.0 \times 10^{-8}$ |
| | | Additive (2) | $4.5 \times 10^{-2}$ |
| | | Gelatin | 0.40 |
| 17th layer | White reflecting layer | Titanium dioxide | 0.70 |
| | | Gelatin | 0.18 |
| 16th layer | Yellow color material layer | Yellow dye-releasing compound (1) | 0.53 |
| | | High boiling organic solvent (1) | 0.13 |
| | | Additive (1) | $1.4 \times 10^{-2}$ |
| | | Gelatin | 0.70 |
| 15th layer | Intermediate layer | Gelatin | 0.30 |
| 14th layer | Anti-color mixing layer | Additive (1) | 0.80 |
| | | Polymethyl methacrylate | 0.80 |
| | | Gelatin | 0.45 |
| 13th layer | Green-sensitive layer (high sensitivity) | Internal latent image type direct positive emulsion (octahedron having grain size of 1.6 μm) | 0.64 (as Ag) |
| | | Sensitizing dye (2) | $2.1 \times 10^{-3}$ |
| | | Nucleating agent (1) | $2.5 \times 10^{-8}$ |
| | | Additive (2) | 0.08 |
| | | Gelatin | 1.00 |
| 12th layer | Green-sensitive layer (low sensitivity) | Internal latent image type direct positive emulsion (octahedron having grain size of 1.0 μm) | 0.20 (as Ag) |
| | | Sensitizing dye (2) | $1.1 \times 10^{-3}$ |
| | | Nucleating agent (1) | $4.4 \times 10^{-8}$ |
| | | Additive (2) | 0.03 |
| | | Gelatin | 0.50 |
| 11th layer | White reflecting layer | Titanium dioxide | 1.00 |
| | | Gelatin | 0.25 |
| 10th layer | Magenta color material layer | Magenta dye-releasing compound (1) | 0.50 |
| | | High boiling organic solvent (1) | 0.10 |
| | | Additive (1) | $9.0 \times 10^{-3}$ |
| | | Gelatin | 0.90 |
| 9th layer | Intermediate layer | Gelatin | 0.30 |
| 8th layer | Anti-color mixing layer | Additive (1) | 1.20 |
| | | Polymethyl methacrylate | 1.20 |
| | | Gelatin | 0.70 |
| 7th layer | Red-sensitive layer (high sensitivity) | Internal latent image type direct positive emulsion (octahedron having grain size of 1.6 μm) | 0.40 (as Ag) |
| | | Sensitizing dye (1) | $6.2 \times 10^{-4}$ |
| | | Nucleating agent (1) | $5.0 \times 10^{-8}$ |
| | | Additive (2) | 0.04 |
| | | Gelatin | 1.80 |
| 6th layer | Red- | Internal latent image type | 0.12 |

TABLE 1-continued

| Structure of the comparative light-sensitive element 101 | | | |
|---|---|---|---|
| Layer No. | Layer name | Additive | Coated amount ($g/m^2$) |
| | sensitive layer (high sensitivity) | direct positive emulsion (octahedron having grain size of 1.0 μm) | (as Ag) |
| | | Sensitizing dye (1) | $3.0 \times 10^{-4}$ |
| | | Nucleating agent (1) | $5.0 \times 10^{-8}$ |
| | | Additive (2) | 0.02 |
| | | Gelatin | 0.40 |
| 5th layer | White reflecting layer | Titanium dioxide | 3.00 |
| | | Gelatin | 0.80 |
| 4th layer | Cyan color material layer | Cyan dye-releasing compound (1) | 0.50 |
| | | High boiling organic solvent (1) | 0.10 |
| | | Additive (1) | 0.10 |
| | | Gelatin | 1.0 |
| 3rd layer | Opaque layer | Carbon black | 1.70 |
| | | Gelatin | 1.70 |
| 2nd layer | White reflecting layer | Titanium dioxide | 22.00 |
| | | Gelatin | 2.75 |
| 1st layer | Image-receiving layer | Polymer mordant | 3.00 |
| | | Gelatin | 3.00 |

Support (polyethylene terephthalate 150 μm)
Polymer mordant

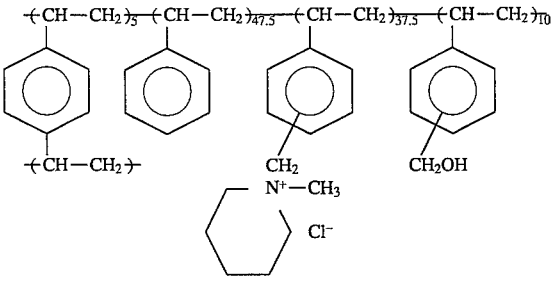

UV absorber (1)

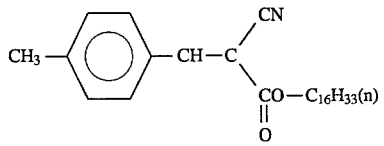

UV absorber (2)

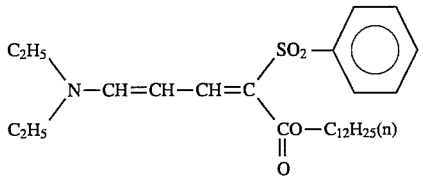

Matting agent (1)
Polymethylmethacrylate latex
(sphere having 4 μm average diameter)
Cyan dye releasing compound (1)

TABLE 1-continued
| Structure of the comparative light-sensitive element 101 | | | |
|---|---|---|---|
| Layer No. | Layer name | Additive | Coated amount ($g/m^2$) |
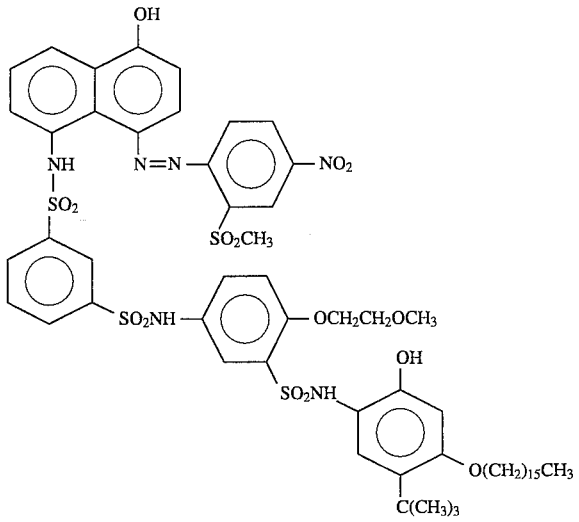
Magenta dye releasing compound (1)
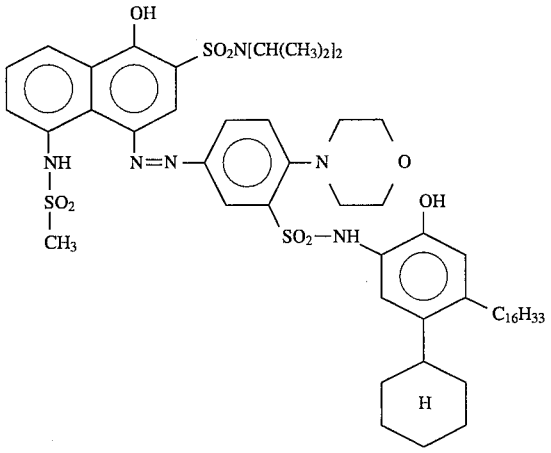
Yellow dye releasing compound (1)
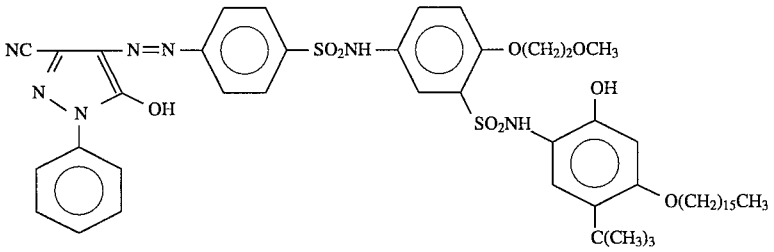
Additive (1)
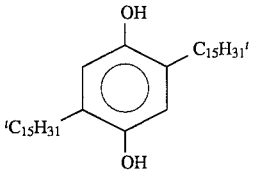

TABLE 1-continued

| Structure of the comparative light-sensitive element 101 | | | |
|---|---|---|---|
| Layer No. | Layer name | Additive | Coated amount ($g/m^2$) |
| Additive (2) | | 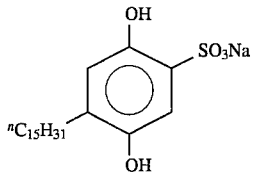 | |
| High boiling organic solvent (1) Tricyclohexylphosphate | | | |
| Nucleating Agent (1) | | 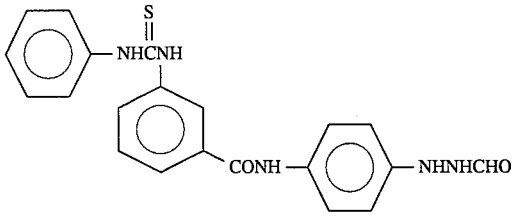 | |
| Sensitizing dye (1) | | 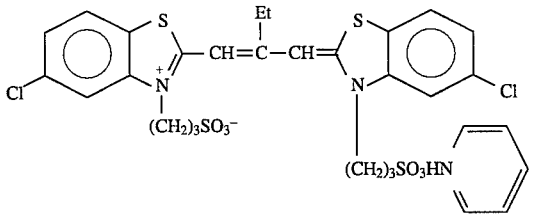 | |
| Sensitizing dye (2) | | 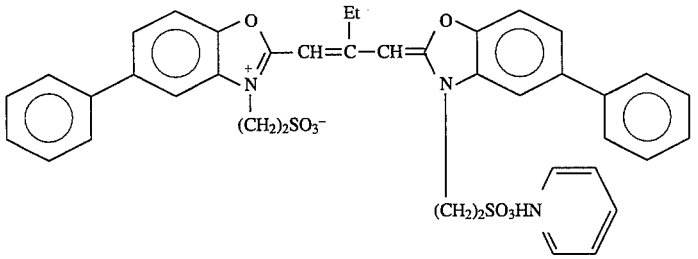 | |
| Sensitizing dye (3) | | 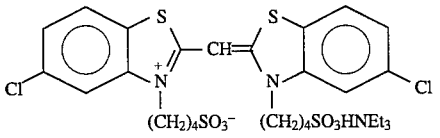 | |

Next, the light-sensitive materials were prepared in the same manner as in the comparative light-sensitive material 101, except that the yellow coloring material contained in the sixteenth layer (a yellow coloring material layer) was replaced with the compounds of the present invention in equimolar amount as shown in Table 2.

A cover sheet was prepared as follows.

The following layers were coated on a polyethylene terephthalate transparent support subbed with gelatin and containing an anti-light piping dye:

(1) A neutralizing layer containing an acrylic acid-butyl acrylate copolymer (mole ratio 8:3) 10.4 $g/m^2$ having a weight average molecular weight of 50,000 and 1,4-bis-2,3-epoxypropoxy)-butane 0.1 $g/m^2$.

(2) A neutralization timing layer containing acetyl cellulose 4.3 $g/m^2$ having an acetylation degree of 51% and copolymer of (methyl vinyl ether/monomethyl maleate) 0.2 g/m$^2$.

(3) A layer containing a blend 1.0 g/m$^2$ as the whole solid matters consisting of a polymer latex prepared by emulsion-polymerizing styrene/butyl acrylate/acrylic acid-N-methylolacrylamide in a weight ratio of 49.7:42.3:8 and a polymer latex prepared by emulsion-polymerizing methyl methacrylate/acrylic acid/N-methylolacrylamide in a weight ratio of 93:3:4, wherein the polymer latexes were blended so that the solid matters ratio became 6:4.

The alkali processing composition is shown below.

The processing solution 0.8 g of the following composition was charged into a breakable vessel.

| | |
|---|---|
| 1-p-Tolyl-4-hydroxymethyl-4-methyl-3-pyrazolidone | 10.0 g |
| Methylhydroquinone | 0.18 g |
| 5-Methylbenzotriazole | 3.0 g |
| Sodium sulfite (anhydride) | 0.2 g |
| Benzyl alcohol | 1.5 ml |
| Sodium carboxymethyl cellulose | 58 g |
| Carbon black | 150 g |
| Potassium hydroxide (28% aqueous solution) | 200 ml |
| Water | 680 ml |

The processing solution of the above composition was charged by each 0.8 g into the vessels which may be breakable by pressure.

The above light-sensitive materials were exposed from the emulsion layer side via a gray filter. Then, they were superposed on the above cover sheets, and the above processing solution was spread between both materials with a pressurized roller at 25° C. so that the thickness became 75 μm.

Photographic performances were evaluated with a minimum density (Dmin) and a maximum density (Dmax) which were obtained with a reflecting density in aging for one day after processing.

Measurement was carried out with a Fuji densitometer (F.S.D).

The results are shown in Table 2.

TABLE 2

| light-sensitive material | Compound of the invention | Yellow reflection density Dmin | Dmax |
|---|---|---|---|
| 101 (Comp.) | — | 0.20 | 1.29 |
| 102 (Comp.) | R-1 | 0.20 | 1.63 |
| 103 (Comp.) | R-2 | 0.20 | 1.42 |
| 104 (Inv.) | R-1 | 0.20 | 1.82 |
| 105 (Inv.) | I-2 | 0.20 | 1.86 |
| 106 (Inv.) | I-3 | 0.20 | 1.84 |
| 107 (Inv.) | I-4 | 0.20 | 1.80 |
| 108 (Inv.) | I-5 | 0.20 | 1.78 |
| 109 (Inv.) | I-6 | 0.20 | 1.86 |
| 110 (Inv.) | I-7 | 0.20 | 1.88 |
| 111 (Inv.) | I-8 | 0.20 | 1.78 |
| 112 (Inv.) | I-9 | 0.20 | 1.77 |
| 113 (Inv.) | I-10 | 0.20 | 1.77 |
| 114 (Inv.) | I-12 | 0.20 | 1.87 |

TABLE 2-continued

| light-sensitive material | Compound of the invention | Yellow reflection density Dmin | Dmax |
|---|---|---|---|
| | (R-1) 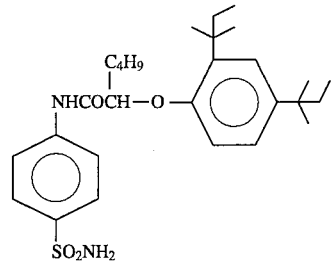 | | |
| | (R-2) 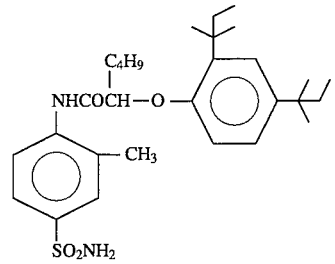 | | |

As apparent from the results shown in Table 2, it can be found that in the case where the compounds of the present invention were added, a marked increase in a transferred density was observed without increasing Dmin.

While the increase in the transferred density was found in the compound described in Japanese patent application No. 5-99485 (which corresponds to U.S. Ser. No. 08/233,701), it was not enough and such a sufficient effect as observed in the compounds of the present invention was not attained.

Example 6

The light-sensitive materials were prepared in the same manner as in Example 5, except that the compounds of the present invention as shown in Table 2 were added to the fourth layer, cyan color material layer, the tenth layer, magenta color material layer and the sixteenth layer, yellow color material layer, respectively, in each amount of 100 mole % based on the amounts of the color materials.

The processing of Example 5 was repeated at a temperatures of 5° C. and 25° C. to evaluate the maximum image densities (Dmax) of yellow, magenta and cyan color.

The results are shown in Table 3.

TABLE 3

| Light-sensitive material | Compound of the invention | Dm in processing at 5° C. $D_R$ | $D_G$ | $D_R$ | Dm in processing at 25° C. $D_R$ | $D_G$ | $D_R$ |
|---|---|---|---|---|---|---|---|
| 201 (Comp.) | — | 0.97 | 1.21 | 1.52 | 1.29 | 1.54 | 1.90 |
| 202 (Comp.) | R-1 | 1.57 | 1.90 | 1.95 | 1.63 | 1.96 | 2.02 |
| 203 (Comp.) | R-2 | 1.24 | 1.48 | 1.83 | 1.42 | 1.69 | 2.09 |
| 204 (Inv.) | I-1 | 1.82 | 2.17 | 2.68 | 1.82 | 2.19 | 2.70 |
| 205 (Inv.) | I-2 | 1.84 | 2.18 | 2.70 | 1.86 | 2.20 | 2.71 |
| 206 (Inv.) | I-3 | 1.82 | 2.16 | 2.68 | 1.84 | 2.18 | 2.70 |
| 207 (Inv.) | I-4 | 1.76 | 2.14 | 2.64 | 1.80 | 2.15 | 2.65 |
| 208 (Inv.) | I-5 | 1.74 | 2.08 | 2.60 | 1.78 | 2.10 | 2.61 |
| 209 (Inv.) | I-6 | 1.85 | 2.20 | 2.69 | 1.86 | 2.22 | 2.70 |
| 210 (Inv.) | I-7 | 1.87 | 2.23 | 2.73 | 1.88 | 2.25 | 2.75 |
| 211 (Inv.) | I-8 | 1.74 | 2.08 | 2.61 | 1.78 | 2.10 | 2.62 |

TABLE 3-continued

| Light-sensitive material | Compound of the invention | Dm in processing at 5° C. | | | Dm in processing at 25° C. | | |
|---|---|---|---|---|---|---|---|
| | | $D_R$ | $D_G$ | $D_R$ | $D_R$ | $D_G$ | $D_R$ |
| 212 (Inv.) | I-9 | 1.75 | 2.06 | 2.59 | 1.77 | 2.11 | 2.60 |
| 213 (Inv.) | I-10 | 1.74 | 2.06 | 2.57 | 1.77 | 2.09 | 2.61 |
| 214 (Inv.) | I-12 | 1.86 | 2.18 | 2.60 | 1.88 | 2.19 | 2.62 |

As apparent from the results shown in Table 3, it can be found that in the case where the compounds of the present invention were used, not only the transferred densities of the respective colors were increased but also a processing temperature dependency (difference in Dmax at 5° C. and 25° C.) was notably improved.

While improvement in the processing temperature dependency was found in the compound described in Japanese patent application No. 5-99458 (which corresponds to U.S. Ser. No. 08/233,701), it was not enough and such a sufficient effect as observed in the compounds of the present invention was not attained.

Example 7

The light-sensitive materials in Example 6 which had been processed were exposed to a fluorescent light of 17000 lux for 3 weeks. A photofading rate (a ratio of a difference between the maximum densities before and after exposing light to the maximum density before exposing light) was obtained from the measured values of the maximum densities before and after exposing light.

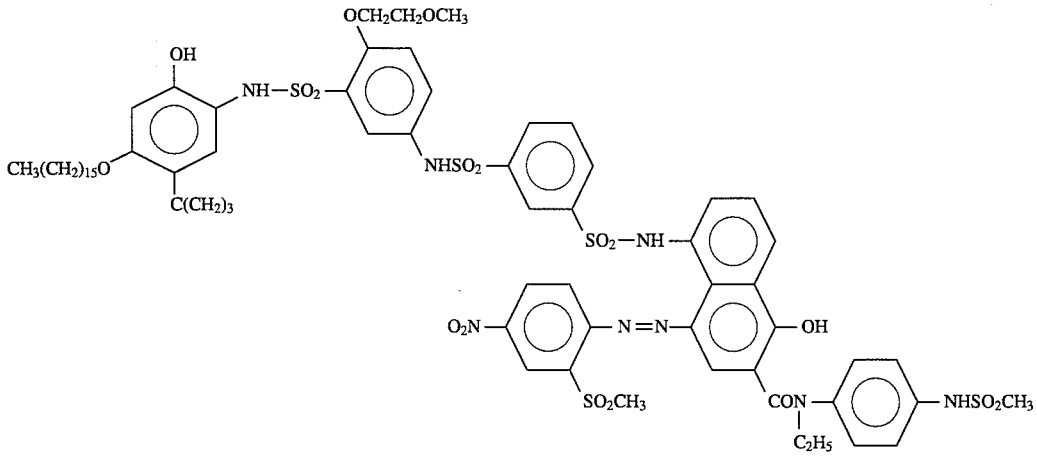

The results are shown in Table 4.

TABLE 4

| Light sensitive material | Compound of the invention | Light fading rate of yellow (%) |
|---|---|---|
| 201 (Comp.) | — | 11.6 |
| 202 (Comp.) | R-1 | 11.4 |
| 203 (Comp.) | R-2 | 11.4 |
| 204 (Inv.) | I-1 | 8.2 |
| 205 (Inv.) | I-2 | 8.1 |
| 206 (Inv.) | I-3 | 8.2 |
| 207 (Inv.) | I-4 | 8.3 |
| 208 (Inv.) | I-5 | 8.4 |

TABLE 4-continued

| Light sensitive material | Compound of the invention | Light fading rate of yellow (%) |
|---|---|---|
| 209 (Inv.) | I-6 | 8.1 |
| 210 (Inv.) | I-7 | 8.0 |
| 211 (Inv.) | I-8 | 8.4 |
| 212 (Inv.) | I-9 | 8.5 |
| 213 (Inv.) | I-10 | 8.5 |

As apparent from the results shown in Table 4, it can be found that in the case where the compounds of the present invention were used, a light fastness was markedly improved as well.

Example 8

A comparative light-sensitive element (301) having the structure shown below was prepared.

Light-sensitive element 301:

The respective layers were coated over a polyethylene terephthalate transparent support as shown below to prepare a light-sensitive sheet.

Back layer:

(a) a light-shielding layer containing carbon black 4.0 g/m$^2$ and gelatin 2.0 g/m$^2$.

Emulsion layer side:

(1) A layer containing the following cyan dye-releasing redox compound 0.44 g/m$^2$, tricyclohexyl phosphate 0.09 g/m$^2$, 2,5-di-t-pentadecylhydroquinone 0.008 g/m$^2$, and gelatin 0.8 g/m$^2$.

(2) A layer containing gelatin 0.5 g/m$^2$.

(3) A red-sensitive emulsion layer containing a red-sensitive internal latent image type direct positive silver bromide emulsion ( 0.6 g/m$^2$ in terms of a silver amount), gelatin 1.2 g/m$^2$, the following nucleating agent 0.015 g/m$^2$, and sodium 2-sulfo-5-n-pentadecylhydroquinone 0.06 g/m$^2$.

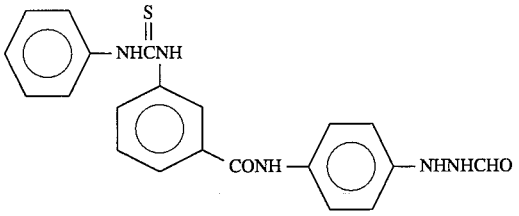

(4) A layer containing 2,5-di-t-pentadecylhydroquinone 0.43 g/m$^2$, tricyclohexyl phosphate 0.1 g/m$^2$, and gelatin 0.4 g/m$^2$.

(5) A layer containing the following magenta dye-releasing redox compound 0.3 g/m$^2$, tricyclohexyl phosphate 0.08 g/m$^2$, 2,5-di-t-pentadecylhydroquinone 0.009 g/m$^2$, and gelatin 0.5 g/m$^2$.

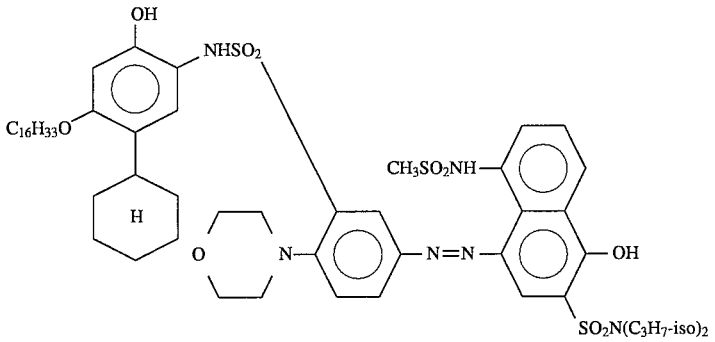

(6) A green-sensitive emulsion layer containing a green-sensitive internal latent image type direct positive silver bromide emulsion (0.42 g/m$^2$ in terms of a silver amount), gelatin 0.9 g/m$^2$, the same nucleating agent as that contained in the layer (3) 0.013 mg/m$^2$, and sodium 2-sulfo-5-n-pentadecylhydroquinone 0.07 g/m$^2$.

(7) The same layer as (4).

(8) A layer containing the following yellow dye-releasing redox compound 0.53 g/m$^2$, tricyclohexyl phosphate 0.13 g/m$^2$, 2,5-di-t-pentadecylhydroquinone 0.014 g/m$^2$, and gelatin 0.7 g/m$^2$.

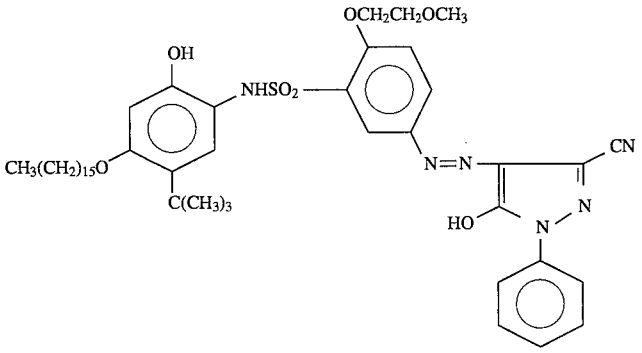

(9) A blue-sensitive emulsion layer containing a blue-sensitive internal latent image type direct positive silver bromide emulsion (0.6 g/m$^2$ in terms of a silver amount), gelatin 1.1 g/m$^2$, the same nucleating agent as that contained in the layer (3) 0.019 mg/m$^2$, and sodium 2-sulfo-5-n-pentadecylhydroquinone 0.05 g/m$^2$.

(10) A layer containing gelatin 1.0 g/m$^2$.

Separately, the light-sensitive materials were prepared in the same manner as described above, except that the compounds of the present invention were added to the layers containing cyan, magenta and yellow dye-releasing redox compounds, respectively, in an amount of 100 mol % as shown in Table 5.

Dye image-receiving sheet:

An image-receiving sheet having the layer structure shown in Table 5 was prepared.

TABLE 5

| Layer No. | Layer name | Additive | Coated amount |
|---|---|---|---|
| | | (Dye-fixing element) | |
| F6 layer | Protective layer | Gelatin | 0.6 g/m$^2$ |
| F5 layer | Mordant layer | Gelatin | 3.0 g/m$^2$ |
| | | Mordant (A) | 3.0 g/m$^2$ |
| | | Coating aid (B) | 0.1 g/m$^2$ |
| F4 layer | Timing layer (1) | polymer latex (1)* | 0.96 g/m$^2$ |
| | | Polymer latex (2)** | 0.64 g/m$^2$ |

TABLE 5-continued

| | | | |
|---|---|---|---|
| F3 layer | Intermediate layer | Poly(2-hydroxyethyl methacrylate | 0.4 g/m² |
| F2 layer | Timing layer (2) | Cellulose acetate (acetylation: 51.3%) | 4.27 g/m² |
| | | Styrene/maleic anhydride copolymer (mole ratio 1:1) (weight average molecular weight: 10,000) | 0.23 g/m² |
| F1 layer | Neutralizing layer | Acrylic acid/butyl acrylate (weight average molecular weight: 50,000) (mole ratio 8:2) | 22 g/m² |
| Paper support (150 μm, polyethylene of 30 gm was laminated on both sides thereof) | | | |
| B1 layer | Light-shielding layer | Gelatin | 2.0 g/m² |
| | | Carbon black | 4.0 g/m² |
| B2 layer | White color layer | Gelatin | 1.0 g/m² |
| | | Titanium oxide | 8.0 g/m² |
| B3 layer | Protective layer | Gelatin | 0.6 g/m² |

Coating aid (B)

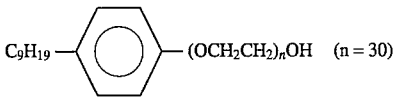

Mordant (A)

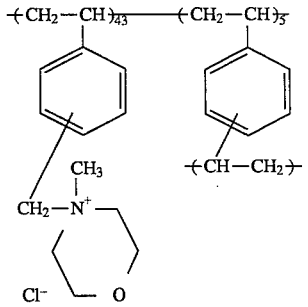

Processing solution:

| | |
|---|---|
| 1-p-Tolyl-4-hydroxymethyl-3-pyrazolidone | 6.9 g |
| Methylhydroquinone | 0.3 g |
| 5-Methylbenzotriazole | 3.5 g |
| Sodium sulfite (anhydride) | 0.2 g |
| Hydroxyethyl cellulose | 58 g |
| Potassium hydroxide (28% aqueous solution) | 200 ml |
| Benzyl alcohol | 1.5 ml |
| Water | 835 ml |

*Prepared by subjecting styrene/butyl acrylate/acrylic acid-N-methylolacrylamide to emulsion-polymerization in a ratio of 49.7/42.3/8.
**Prepared by subjecting methyl methacrylate/acrylic acid/N-methylolacrylamide to emulsion-polymerization in a ratio of 93/3/4.

After imagewisely exposing the light-sensitive sheet, the image-receiving sheet was superposed on the light-sensitive sheet, and processing was carried out so that the processing solution described above was spread between both sheets in the thickness of 60 μm.

The processing was carried out at 25° C., and there was measured the maximum density (Dmax) obtained when the light-sensitive sheet was detached from the image-receiving sheet 90 seconds after the processing.

The results are shown in Table 6.

TABLE 6

| Light sensitive material | Compound of the invention | Dmax DB | Dmax DG | Dmax DR |
|---|---|---|---|---|
| 301 (Comp.) | — | 1.15 | 1.41 | 1.73 |
| 302 (Comp.) | R-1 | 1.46 | 1.78 | 2.18 |
| 303 (Comp.) | R-2 | 1.26 | 1.47 | 1.76 |
| 304 (Inv.) | I-1 | 1.62 | 1.92 | 2.37 |
| 305 (Inv.) | I-2 | 1.69 | 1.83 | 2.41 |
| 306 (Inv.) | I-3 | 1.70 | 1.82 | 2.39 |
| 307 (Inv.) | I-4 | 1.64 | 1.92 | 2.35 |
| 308 (Inv.) | I-5 | 1.62 | 1.91 | 2.33 |
| 309 (Inv.) | I-6 | 1.68 | 1.95 | 2.41 |
| 310 (Inv.) | I-7 | 1.71 | 1.97 | 2.43 |
| 311 (Inv.) | I-8 | 1.64 | 1.82 | 2.34 |
| 312 (Inv.) | I-9 | 1.62 | 1.92 | 2.36 |
| 313 (Inv.) | I-10 | 1.63 | 1.92 | 2.37 |

As apparent from the results shown in Table 6, when the compounds of the present invention were used, marked increase in a transferred density was observed.

Example 9

The light-sensitive material were prepared in the same manner as in Example 6 except that compositions of the seventh and the thirteenth layer were replaced with those disclosed in Table 7 below.

TABLE 7

| Layer No. | Layer Name | Additives | Coating Weight (g/m²) |
|---|---|---|---|
| 16th layer | Red-sensitive layer (high sensitivity) | Internal latent image type direct positive emulsion (hexagonal tabular emulsion having 25 μm of average diameter corresponding to circle of projected area; 0.37 μm in thickness; 14 (μm)³ of average volume) | 0.40 (as Ag) |
| | | Sensitivity Dye (1) | $9.3 \times 10^{-4}$ |
| | | Nucleating Agent (1) | $8.5 \times 10^{-8}$ |
| | | Additive (2) | 0.04 |
| | | Gelatin | 1.80 |
| 13th layer | Green-sensitive layer (high sensitivity) | Internal latent image type type direct positive emulsion (hexagonal tabular emulsion having 25 μm of average diameter corresponding to circle of projected area; 0.37 μm in thickness; 14 (μm)³ of average volume) | 0.64 (as Ag) |
| | | Sensitivity Dye (1) | $3.6 \times 10^{-3}$ |
| | | Nucleating Agent (1) | $4.3 \times 10^{-8}$ |
| | | Additive (2) | 0.08 |
| | | Gelatin | 1.00 |

The processings as of Example 5 was repeated at 25° C. to evaluate the maximum image densities (Dmax) of yellow, magenta and cyan color.

The results are shown in Table 8, below.

TABLE 8

| Light-Sensitive Material | Additive | Dmax after processing at 25° C. $D_R$ | $D_G$ | $D_R$ | Remarks |
|---|---|---|---|---|---|
| 201 | — | 1.29 | 1.54 | 1.91 | Comparison |
| 202 | R-1 | 1.63 | 1.99 | 2.04 | " |
| 203 | R-2 | 1.43 | 1.71 | 2.12 | " |
| 204 | I-1 | 1.81 | 2.21 | 2.72 | Invention |
| 205 | I-2 | 1.86 | 2.23 | 2.74 | " |
| 206 | I-3 | 1.83 | 2.20 | 2.73 | " |
| 207 | I-4 | 1.80 | 2.17 | 2.68 | " |
| 208 | I-5 | 1.78 | 2.13 | 2.63 | " |
| 209 | I-6 | 1.86 | 2.24 | 2.71 | " |
| 210 | I-7 | 1.87 | 2.28 | 2.77 | " |
| 211 | I-8 | 1.77 | 2.13 | 2.65 | " |
| 212 | I-9 | 1.77 | 2.14 | 2.63 | " |
| 213 | I-10 | 1.77 | 2.12 | 2.64 | " |
| 214 | I-12 | 1.88 | 2.22 | 2.65 | " |

As apparent from the results shown in Table 8, it can be seen that in the case where the compounds of the present invention were used, the transferred image densities were remarkably increase without suffering from increasing Dmim.

Further, improvement in the transferred image density was formed in the compound disclosed in Japanese Patent Application (which corresponds to U.S. Ser. No. 08/233,701), it was not considered as being enough. Thus, the advantages of the present invention is clearly demonstrated.

While the invention has been described in detail and with reference to specific embodiments thereof, it will be apparent to one skilled in the art that various changes and modifications can be made therein without departing from the spirits and scope thereof.

What is claimed is:

1. A color diffusion transfer film unit comprising:

(a) a light-sensitive sheet comprising a transparent support having provided thereon an image-receiving layer, a white color reflection layer, a light-shielding layer, at least one silver halide emulsion layer combined with at least one dye image-forming compound, and at least one compound represented by Formula (I):

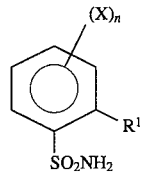

(I)

wherein $R^1$ represents an alkyl group; X represents an alkyl group, a cycloalkyl group, an aryl group, alkoxy group, an aryloxy group, an acylamino group, a sulfonylamino group, a ureido group, an alkylthio group, an arylthio group, an alkoxycarbonyl group, a carbamoyl group, a sulfamoyl group, a sulfonyl group, an alkoxycarbonylamino group, an amino group, a sulfamoylamino group, a cyano group, a hydroxy group, or a halogen atom; n represents an integer of 1 to 4; and when n is 2 or more, the plural X groups may be the same or different;

(b) a transparent cover sheet having at least a neutralizing layer and a neutralization timing layer on a transparent support; and (c) an alkaline processing composition spread between the light-sensitive sheet and the transparent cover sheet.

2. The color diffusion transfer film unit of claim 1, wherein the alkali processing composition is a light-shielding alkali processing composition.

3. The color diffusion transfer film unit as claimed in claim 1, wherein n in the formula (I) is 1 or 2.

4. The color diffusion transfer film unit as claimed in claim 1, wherein n in the formula (I) is 1.

5. The color diffusion transfer film unit as claimed in claim 1, wherein there is a total of at least 8 carbon atoms in the substituent group or groups represented by $(X)_n$.

6. The color diffusion transfer film unit as claimed in claim 1, wherein there is a total of at least 12 carbon atoms in the substituent group or groups represented by $(X)_n$.

7. The color diffusion transfer film unit as claimed in claim 1, wherein X in the formula (I) represents an alkyl group, an alkoxy group, an aryloxy group, an acylamino group, a ureido group, or an alkoxy carbonylamino group.

8. The color diffusion transfer film unit as claimed in claim 1, wherein the compound of formula (I) is a compound represented by formula (II):

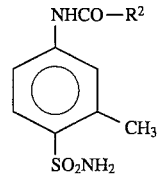

(II)

wherein $R^2$ represents substituted or unsubstituted alkyl group.

9. The color diffusion transfer film unit as claimed in claim 1, wherein the compound of formula (I) is a compound represented by formula (III):

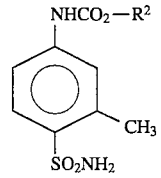

(III)

wherein $R^2$ represents a substituted or unsubstituted alkyl group.

10. A color diffusion transfer light-sensitive material, wherein the light-sensitive material is a color diffusion transfer film unit comprising (a) an image-receiving sheet comprising a neutralizing layer, a neutralization timing layer, an image-receiving layer and a peeling layer each provided in order on a support, (b) a light-sensitive sheet comprising at least one compound represented by Formula (I) and having at least one silver halide emulsion layer combined with at least one dye image-forming compound on a support having a light-shielding layer, and (c) an alkaline processing composition spread between the image-receiving sheet and the light-sensitive sheet:

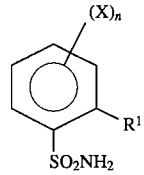

(I)

wherein $R^1$ represents an alkyl group; X represents an alkyl group, a cycloalkyl group, an aryl group, an alkoxy group, an aryloxy group, an acylamino group, a sulfonylamino group, a ureido group, an alkylthio group, an arylthio group, an alkoxycarbonyl group, a carbamoyl group, a sulfamoyl group, a sulfonyl group, an alkoxycarbonylamino group, an amino group, a sulfamoylamino group, a cyano group, a hydroxyl group, or a halogen atom; n represents an integer of 1 to 4; and where n is 2 or more, the plural X groups may be the same or different.

11. The color diffusion transfer light-sensitive material of claim 10, wherein the alkaline processing composition is a light-shielding alkaline processing composition.

12. The color diffusion transfer light-sensitive material of claim 10, wherein n in formula (I) is 1 or 2.

13. The color diffusion transfer light-sensitive material of claim 10, wherein n in formula (I) is 1.

14. The color diffusion transfer light-sensitive material of claim 10, wherein there is a total of at least 8 carbon atoms in the substituent group or groups represented by $(X)_n$.

15. The color diffusion transfer light-sensitive material of claim 10, wherein there is a total of at least 12 carbon atoms in the substituent group or groups represented by $(X)_n$.

16. The color diffusion transfer light-sensitive material of claim 10, wherein X in formula (I) represents an alkyl group, an alkoxy group, an aryloxy group, an acylamino group, a ureido group, or an alkoxy carbonylamino group.

17. The color diffusion transfer light-sensitive material of claim 10, wherein the compound of formula (I) is a compound represented by formula (II):

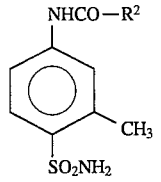

(II)

wherein $R^2$ represents a substituted or unsubstituted alkyl group.

18. The color diffusion transfer light-sensitive material of claim 10, wherein the compound of formula (I) is a compound represented by formula (III):

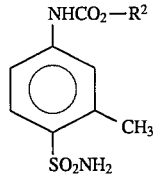

(III)

wherein $R^2$ represents a substituted or unsubstituted alkyl group.

* * * * *